United States Patent [19]

Thwaites

[11] Patent Number: 4,649,089

[45] Date of Patent: Mar. 10, 1987

[54] INTUMESCENT MATERIALS

[75] Inventor: Peter J. Thwaites, Eltisley, England

[73] Assignee: Dufaylite Developments Limited, St. Neots, England

[21] Appl. No.: 785,669

[22] Filed: Oct. 9, 1985

[30] Foreign Application Priority Data

Oct. 9, 1984 [GB] United Kingdom ..... 8425454

[51] Int. Cl.[4] ..... E16J 15/00; E06B 7/16

[52] U.S. Cl. ..... 428/913; 428/921; 52/1; 52/232

[58] Field of Search ..... 428/913, 921; 52/1, 52/2, 232

[56] References Cited

U.S. PATENT DOCUMENTS 3,955,330 5/1976 Wendt ..... 52/204
3,964,214 6/1976 Wendt ..... 52/1
4,045,930 9/1977 Dixon ..... 52/232
4,144,688 3/1979 Dixon ..... 52/232
4,354,304 10/1982 Dixon ..... 29/527.1

*Primary Examiner*—John E. Kittle
*Assistant Examiner*—Patrick J. Ryan
*Attorney, Agent, or Firm*—A. W. Breiner

[57] ABSTRACT

The invention provides an improved casing material for locating, at door edges a brush-like material for preventing the passage of cold smoke, and an intumescent material which expands to obstruct. A tubular body has a slot for the bristles which project outwardly from a brush-base located inside the casing, and an internal housing for the brush base isolates the slot from an interior portion of the body. A second slot is provided opposite the first slot. The construction of the body is such that the slots can be opened locally so that the brush base can be fitted through the first slot and the intumescent material may be passed, in strip form, through the second slot.

7 Claims, 8 Drawing Figures

INTUMESCENT MATERIALS

The present invention relates to intumescent materials.

It is an established practice to provide one or more edges of a door with a brush-like material and with a thermoplastic casing which houses an intumescent material. The brush smoke seal prevents the passage of cold smoke during the early stages of a fire which may be developing some distance from the door or seals in question. As the fire approaches and the temperature rises, the thermo-plastic casing starts to melt and simultaneously the intumescent material reacts and expands to close the gap between the door edge and the frame to block both smoke and fire.

An object of the present invention is to provide an improved form of mounting for the brush-like and intumescent materials.

In accordance with the present invention, there is provided a casing material for a sealing strip having a brush-like component for the normal sealing of a gap and an intumescent material for reacting to fill the gap under fire conditions, said casing material having a body of generally tubular cross-section and having formed along one face a first longitudinal slot, for locating a brush component having a base and bristles projecting from said base, a partition extending internally along said member and having a base spaced from the slot and side walls joining said base to said body at positions spaced from said slot, a pair of projections for securing the base of the brush-like component between said partition and said slot with the bristles of said component extending outwardly through said slot, and a second slot formed in the wall of said body on the side of the partition opposite the side having the first slot isolated from said first slot by said partition, the arrangement being such that the second slot may be opened locally to receive the intumescent material provided in the form of at least one strip and introduced in a progressive manner, the first slot may be opened locally to receive the brush component when similarly introduced, and both slots close after their receptions.

The casing material, which is conveniently formed by extrusion of a thermoplastic material, is fitted, for use, with (a) a brush-like component fitted in the first slot and retained by the part and projecting beyond the slot to, or to the neighbourhood of, the side walls and (b) an intumescent material, provided in the form of at least one strip, inserted through the second slot.

Fitting the brush component involves flexure of the casing material, including the partition. Flexure is also required to open the second slot for the fitting of the strip or strips of intumescent material through the second slot and it is found that this flexure is facilitated by forming the face having the first slot with a lesser thickness than the remainder of the body.

By appropriate dimensioning of the casing, it can be arranged that the flexure required for fitting the strip or strips leaves a gripping force thereon after fitting.

There are two main situations in which a material as provided by the invention may be employed, ie. with swing doors, or with frame doors. For use with swing doors the face formed with the first slot preferably has a convex configuration and for use with a door installed in a door frame the face preferably has a substantially flat configuration. In both cases the material is preferably mounted in a slot formed in the edge of the door.

The following description in which reference is made to the accompanying drawings, is given to illustrate the invention. In the drawings.

Figure 1:
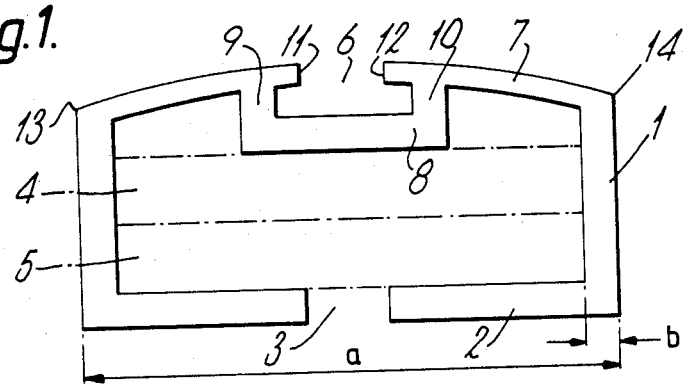
FIG. 1 shows in end elevation an embodiment of the invention.

The embodiment of FIG. 1 has a tubular body 1 formed of polyvinyl chloride and profiled as shown for fitting to swing doors. Dimensions a and b are 20 mm and 1.25±0.1 mm respectively. Other dimensions are shown on the same scale.

At its base 2, the body is formed with a slot 3 for the insertion of the intumescent material e.g. the two strips 4 and 5 shown in broken lines. A slot 6 for the outwardly directed bristles of a brush (not shown) is formed along the centre of the outer wall 7.

The tubular body is normally formed by extrusion and in a preferred arrangement the slots 3 and 6 are produced by the extrusion process itself, using an extrusion die designed for this purpose. Either or both slots may, alternatively be produced by cutting, in a subsequent operation, by a saw or router but the operation tends to give less favourable results including leaving the slot or slots with rough edges.

Within the body is an integral partition 8, for seating the base of the brush, joined to the outer wall 7 by side walls 9 and 10 which are spaced away from the edges 11 and 12 of slot 6 to retain the base of the brush.

The outer wall 7 is curved as shown between corners 13 and 14 and has a smaller thickness than the remainder of the body to facilitate deformation of the body 1 to permit the insertion of strips 4 and 5.

In a modification for use with doors closing into a door frame, rather than swing doors, outer wall 7 is made flat, rather than curved.

Figure 3:
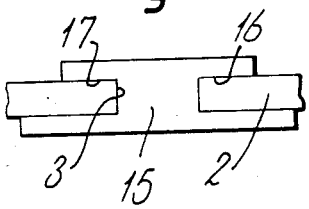

Slot 3 can be sealed by a length of adhesive tape, not shown, or by sliding into position a closure strip 15, shown in FIG. 3, profiled as shown to provide a pair of slots 16 and 17. Strip 15 may be shaped to assist the location of the intumescent material in a required position within the body 1.

Figure 2:
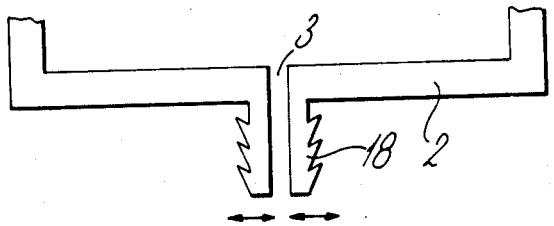
FIGS. 2 to 5 show in end elevation modifications of the embodiment of FIG. 1.

As an alternative (shown in FIG. 2) the base 2 may be formed with a pair of ribbed projections 18, one on each side of the slot. In use of the material, these projections are accommodated in a corresponding slot formed centrally in the base of the main receiving slot of the door or other structure to which the seal is to be fitted.

Figure 4:
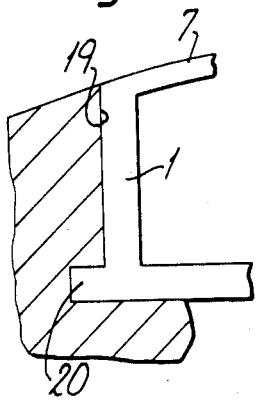

The inclination of the projections 18 opposes withdrawal from the receiving slot. In another arrangement shown in FIG. 4, the receiving slot 19 is recessed to engage projections 20 provided on body 1.

Figure 5:
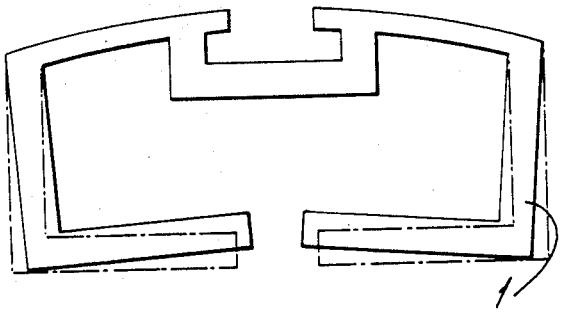

If desired, the intumescent material may be made narrow to facilitate assembly and coated on its edges with adhesive. In a modified arrangement, the body 1 is extruded with the shape shown in solid lines in FIG. 5 and the intumescent strip or strips are dimensioned to force-out the body to the rectangular form shown in broken lines. The reaction on the strip or strips then provides a gripping action to assist retention of the intumescent material.

Figure 6:
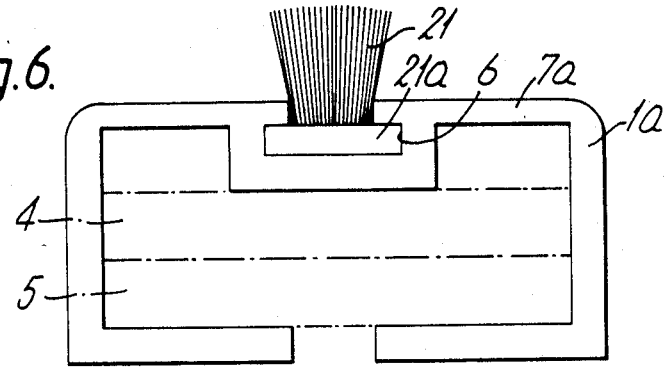
FIG. 6 shows in end elevation an embodiment of the type shown in FIG. 5 with a brush fitted.
Figure 7:
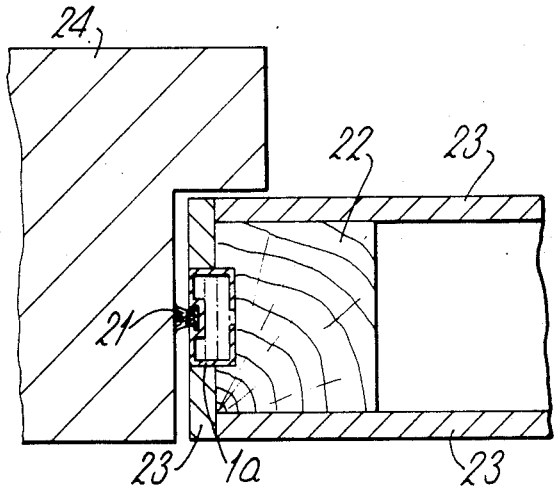
FIG. 7 is a horizontal cross section showing part of a door closed into a door frame.

FIGS. 6 and 7 show a tubular body 1*a* similar to that of FIG. 1 but with the outer wall 7*a* generally flat rather than curved. A brush component having a base 21*a*, fitted within the slot 6, has bristles 21 projecting outwardly as shown. In use, the body is fitted into the grooved edge of a door having a peripheral frame 22 faced with panelling 23 and hingedly mounted to be swung into and out of engagement with door frame 24. In the closed position of the door shown in FIG. 7 the bristles of the brush engage the frame to minimise or prevent the passage of smoke. If the door is strongly heated by fire, the intumescent material 4, 5 foams and bursts from the body 1*a* to provide a seal between the door and frame 24.

Figure 8:
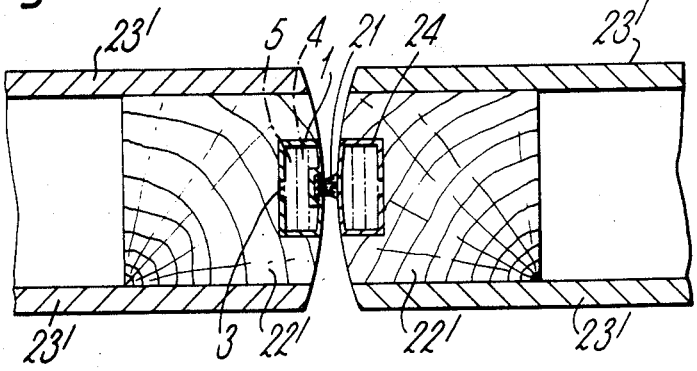
FIG. 8 is a horizontal cross section of part of two swing doors in closed relationship.

FIG. 8 shows the adjacent parts of a pair of swing doors each having a frame part 22' and facing panels 23'. As shown, one of the pair is grooved to receive an embodiment as described with reference to FIG. 1. The arrangement functions as described with reference to FIG. 7.

The second of the pair is preferably also provided with an intumescent material in a casing of the kind shown in FIGS. 1 to 6 fitted into a slot so that there is an intumescent reaction from both doors to ensure that the doors are sealed at the meeting edge even if air pressure should move the doors relative to each other.

Under standard test procedures, the embodiments shown in the drawings give a fire-resistance of one hour.

It will be understood that the embodiments specifically described herein are provided for purposes of illustration only and that various departures may be made therefrom without departing from the scope of the invention.

I claim:

1. A fire resistant assembly consisting of an elongate casing, an elongate brush having a base and bristles projecting to one side thereof, and at least one elongate preformed strip of intumescent material, the assembly being designed for the normal sealing of a gap and the intumescent material and the casing being adapted to react to fill the gap under fire conditions, wherein the casing is a body of generally tubular cross-section made of thermoplastic material and having formed along one face a first longitudinal slot for locating the brush therein with bristles of the brush projecting from the face, a partition extending internally along the casing and having a base spaced from the slot and side walls joining the base to the body at positions spaced from the slot thereby providing, between the side walls and the slot, a pair of projections for securing the base of the brush between the partition and the slot with the bristles extending outwardly through the slot and the base within the casing, and having a second longitudinal slot formed in the wall of the body on the side of the partition opposite the side having the first slot, and isolated from the first slot by the partition, and the at least one strip of intumescent material being located within the casing on the side of the partition opposite the brush.

2. A casing material according to claim 1 in which the casing is formed by extrusion of a thermoplastic material.

3. A casing material according to claim 1 in which the casing material has a reduced wall thickness in the region of the first slot.

4. A casing material according to claim 1 in which the face formed with the first slot has a convex configuration.

5. A casing material according to claim 4 when mounted in a recess formed in the edge of a swing door.

6. A casing material according to claim 1 in which the face formed with the first slot has a substantially flat configuration.

7. A casing material according to claim 6 when mounted in a recess formed in the edge of a door installed in a door frame.

* * * * *